US009879501B2

(12) United States Patent
Hammer et al.

(10) Patent No.: US 9,879,501 B2
(45) Date of Patent: Jan. 30, 2018

(54) MULTIZONE RETRIEVAL SYSTEM AND METHOD

(71) Applicants: Aaron C. Hammer, Houston, TX (US); Jason A. Allen, Houston, TX (US); Robert S. O'Brien, Katy, TX (US); Travis E. Cochran, Houston, TX (US); Jai K. Koli, Houston, TX (US)

(72) Inventors: Aaron C. Hammer, Houston, TX (US); Jason A. Allen, Houston, TX (US); Robert S. O'Brien, Katy, TX (US); Travis E. Cochran, Houston, TX (US); Jai K. Koli, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 445 days.

(21) Appl. No.: 14/508,750

(22) Filed: Oct. 7, 2014

(65) Prior Publication Data

US 2015/0252645 A1 Sep. 10, 2015

Related U.S. Application Data

(63) Continuation-in-part of application No. 14/201,394, filed on Mar. 7, 2014, now Pat. No. 9,574,408.

(51) Int. Cl.
*E21B 33/124* (2006.01)
*E21B 43/14* (2006.01)

(52) U.S. Cl.
CPC ..... *E21B 33/124* (2013.01); *E21B 43/14* (2013.01)

(58) Field of Classification Search
CPC ..... E21B 33/124; E21B 43/14; E21B 33/122; E21B 33/128; E21B 33/12
See application file for complete search history.

(56) References Cited

U.S. PATENT DOCUMENTS

| | | | |
|---|---|---|---|
| 80,875 | A | 8/1868 | Platt et al. |
| 85,428 | A | 12/1868 | Burditt et al. |
| 1,342,813 | A | 6/1920 | Huston |
| 3,025,914 | A | 3/1962 | Fether |
| 3,133,595 | A | 5/1964 | Loughney et al. |

(Continued)

FOREIGN PATENT DOCUMENTS

| | | | |
|---|---|---|---|
| EP | 1001132 | A2 | 5/2000 |
| WO | 0026501 | A1 | 5/2000 |

(Continued)

OTHER PUBLICATIONS

PCT International Search Report and Written Opinion; International Application No. PCT/US2014/055889; International Filing Date: Sep. 16, 2014; dated Dec. 23, 2014; pp. 1-10.

(Continued)

*Primary Examiner* — Caroline N Butcher
(74) *Attorney, Agent, or Firm* — Cantor Colburn LLP

(57) ABSTRACT

In one aspect, an apparatus for use in a wellbore is disclosed that in one non-limiting embodiment contains an outer assembly that includes an isolation packer corresponding to each of a plurality of zones along the wellbore, wherein each isolation packer is configured to be set in the wellbore, a release module associated with each isolation packer to release its associated isolation packer after such isolation packer has been set in the wellbore, and a disconnect module below each isolation packer that is armed using a first force and activated using a second force.

19 Claims, 2 Drawing Sheets

(56) References Cited

U.S. PATENT DOCUMENTS

| | | | |
|---|---|---|---|
| 3,504,936 | A | 4/1970 | Brown et al. |
| 3,726,546 | A | 4/1973 | Brown |
| 4,125,129 | A | 11/1978 | Baumann |
| 4,176,717 | A | 12/1979 | Hix |
| 4,281,858 | A | 8/1981 | Bower |
| 4,423,889 | A | 1/1984 | Weise |
| 4,778,008 | A | 10/1988 | Gonzalez et al. |
| 5,122,271 | A | 6/1992 | Simon et al. |
| 5,341,880 | A | 8/1994 | Thorstensen |
| 5,769,122 | A | 6/1998 | Baumann et al. |
| 5,823,264 | A | 10/1998 | Ringgenberg |
| 6,003,607 | A | 12/1999 | Hagen et al. |
| 6,367,552 | B1 | 4/2002 | Scott et al. |
| 6,447,021 | B1 | 9/2002 | Haynes |
| 6,978,840 | B2 | 12/2005 | Henderson |
| 7,055,598 | B2 | 6/2006 | Ross et al. |
| 7,086,479 | B2 | 8/2006 | Schultz et al. |
| 7,284,606 | B2 | 10/2007 | Coronado |
| 7,578,343 | B2 | 8/2009 | Augustine |
| 7,673,678 | B2 | 3/2010 | MacDougall et al. |
| 8,061,430 | B2 | 11/2011 | Du et al. |
| 8,201,623 | B2 | 6/2012 | O'Brien |
| 8,220,555 | B1 | 7/2012 | Wintill et al. |
| 8,286,701 | B2 | 10/2012 | Schultz et al. |
| 8,403,061 | B2 | 3/2013 | Russell et al. |
| 8,424,609 | B2 | 4/2013 | Duphorne et al. |
| 2002/0092653 | A1 | 7/2002 | Scott et al. |
| 2003/0029621 | A1 | 2/2003 | Haynes |
| 2003/0141059 | A1 | 7/2003 | Mauldin et al. |
| 2003/0188894 | A1 | 10/2003 | Sunde et al. |
| 2005/0039916 | A1 | 2/2005 | Schultz et al. |
| 2006/0260818 | A1 | 11/2006 | Meijer et al. |
| 2007/0131434 | A1 | 6/2007 | MacDougall et al. |
| 2010/0224375 | A1 | 9/2010 | Du et al. |
| 2010/0252250 | A1 | 10/2010 | Fripp et al. |
| 2011/0048706 | A1 | 3/2011 | Clem et al. |
| 2011/0079396 | A1 | 4/2011 | Russell et al. |
| 2011/0127047 | A1 | 6/2011 | Themig et al. |
| 2011/0146988 | A1 | 6/2011 | McGlothen |
| 2011/0186286 | A1 | 8/2011 | Allen |
| 2011/0209873 | A1 | 9/2011 | Stout |
| 2011/0226481 | A1 | 9/2011 | Duphorne et al. |
| 2011/0278017 | A1 | 11/2011 | Themig et al. |
| 2012/0085548 | A1 | 4/2012 | Fleckenstein et al. |
| 2013/0108356 | A1 | 5/2013 | Stautzenberger et al. |
| 2013/0112410 | A1 | 5/2013 | Szarka et al. |
| 2013/0199799 | A1 | 8/2013 | Phan et al. |
| 2014/0166312 | A1 | 6/2014 | Richards et al. |
| 2015/0252628 | A1 | 9/2015 | Cochran et al. |
| 2015/0375144 | A1 | 12/2015 | Greci |
| 2016/0084018 | A1 | 3/2016 | Allen |
| 2016/0123093 | A1 | 5/2016 | Richards et al. |

FOREIGN PATENT DOCUMENTS

| | | | |
|---|---|---|---|
| WO | 2007078375 | A2 | 7/2007 |
| WO | 2012162792 | | 12/2012 |
| WO | WO2012162792 | A1 | 12/2012 |

OTHER PUBLICATIONS

PCT International Search Report and Written Opinion; International Application No. PCT/US2014/055886; International Filing Date: Sep. 16, 2014; dated Dec. 19, 2014; pp. 1-9.

PCT International Search Report and Written Opinion; International Application No. PCT/US2014/055887; International Filing Date: Sep. 16, 2014; dated Dec. 18, 2014; pp. 1-10.

PCT International Search Report and Written Opinion; International Application No. PCT/US2015/014607; International Filing Date: Feb. 5, 2015; dated May 19, 2015; pp. 1-10.

PCT International Search Report and Written Opinion; International Application No. PCT/US2014/042081; International Filing Date: Jun. 12, 2014; dated Oct. 6, 2014; pp. 1-14.

PCT International Search Report and Written Opinion; International Application No. PCT/US2015/017515; International Filing Date: Feb. 25, 2015; dated Jun. 8, 2015; 16 Pages.

MULTIZONE RETRIEVAL SYSTEM AND METHOD

CROSS-REFERENCE TO RELATED APPLICATIONS

This application is a continuation in part of U.S. patent application Ser. No. 14/201,394, filed on Mar. 7, 2014, assigned to the assignee of the present application, which is incorporated herein in its entirety by reference.

BACKGROUND

1. Field of the Disclosure

This disclosure relates generally to multi-zone completion apparatus and methods for production of hydrocarbons from subsurface formations.

2. Background of the Art

For fracturing, gravel packing and production from a multi-zone well, a completion assembly containing an outer assembly and an inner assembly are used to perform treatment operations, including fracturing and gravel packing (frac/pack or frac/packing) and flooding or injection operations in each zone before producing the hydrocarbons (oil and gas) from such zones. The outer assembly includes a top packer, a bottom packer and an isolation packer for each zone. To treat a particular zone, such zone is isolated from other zones by setting the packers. A cross-over (also referred to as frac port) in the inner assembly is aligned with a flow port in the outer assembly. A treatment fluid (typically a mixture of water, proppant and additives) is supplied under pressure into the inner string, which treatment fluid flows from the frac port to the formation via the flow port. At times the proppant packed around the frac port can cause the inner string to become stuck in the outer string. To remove the outer string, the inner string is cut off at or above the stuck location. The outer string is then retrieved.

The present disclosure provides apparatus and method for installing and retrieving a multi-zone completion assembly in wellbores.

SUMMARY

In one aspect, an apparatus for use in a wellbore is disclosed that in one non-limiting embodiment includes an outer assembly that further includes an isolation packer corresponding to each of a plurality of zones along the wellbore, wherein each isolation packer is configured to be set in the wellbore, a release module associated with each isolation packer to release the associated isolation packer after such isolation packer has been set in the wellbore, and a disconnect module below each isolation packer that is armed using a first force and activated using a second force.

In another aspect, a method of deploying a retrievable completion assembly in a multi-zone well is disclosed that in one non-limiting embodiment includes: placing an outer assembly and an inner assembly in a multi-zone wellbore, wherein the outer assembly includes: an isolation packer corresponding to each zone; a release module associated with each isolation packer to release its associated isolation packer when the outer string is pulled; and a disconnect module below each isolation packer that is y armed using a first and activated using a second force, wherein the outer string, when pulled upward, will disconnect at an uppermost disconnect module that has been armed and activated; setting each isolation packer; arming each disconnect module: and activating a selected disconnect module to allow for separation of the outer string at the selected activated disconnect module to permit removal of the outer assembly from the wellbore at such activated disconnect module.

Examples of the more important features of a well completion system and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally represented by same numerals and wherein.

DETAILED DESCRIPTION OF THE DRAWINGS

Figure 1:
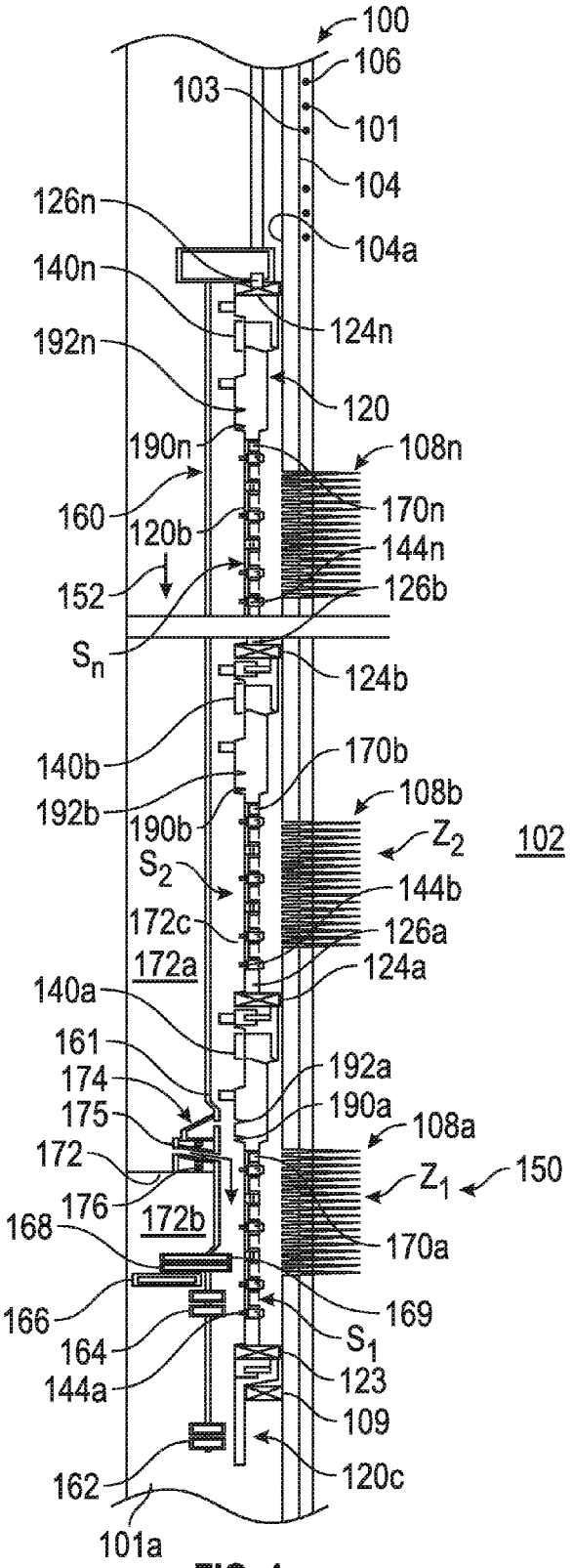
FIG. 1 shows a multi-zone wellbore system including a completion assembly that includes a number of disconnect modules for retrieving the completion assembly from the wellbore, according to one embodiment of the disclosure.

FIG. 1 shows a wellbore system 100 that includes a multi-zone wellbore 101 formed in formation 102 for performing a treatment operation therein, such as fracturing the formation (also referred to herein as fracing or fracking), fracking and gravel packing (frac-pack or frac-packing), flooding, etc. The wellbore 101 is lined with a casing 104, such as a string of jointed metal pipes sections, known in the art. The space or annulus 103 between the casing 104 and the wellbore 101 is filled with cement 106. The formation 102 is shown to include multiple zones Z1-Zn that may be fractured or treated for the production of hydrocarbons therefrom. Each such zone is shown to include perforations that extend through the casing 104 and cement 106 to a certain depth in the formation 102. In FIG. 1, Zone Z1 includes perforations 108*a*, Zone Z2 includes perforations 108*b*, and Zone Zn includes perforations 108*n*. The perforations in each zone provide fluid passage from inside 104*a* of the casing 104 to the formation for supplying a treatment for treating each zone and to allow formation fluid 150 to flow from the formation 120 to the inside 104*a* of the casing 104. The wellbore 101 includes a sump packer 109 proximate to the bottom 101*a* of the wellbore 101. The sump packer 109 is typically deployed after installing casing 104 and cementing the wellbore 101. The wellbore 101 typically is filled with a fluid 152, such as drilling fluid, that provides a hydrostatic pressure sufficient to prevent the formation fluid 150 from entering the interior 104*a* of the casing 104.

Still referring to FIG. 1, to treat the zones Z1-Zn, a system assembly 110 (also referred to as the "completion assembly") that includes an outer assembly or outer string 120 and an inner assembly or inner string 160 (also referred to as the "service string" or "service assembly") are placed or deployed inside the casing 104. In one non-limiting embodiment, the outer string 120 includes a number of devices associated with or corresponding to each of the zones Z1-Zn for performing the treatment operations. In one non-limiting embodiment, the outer string 120 includes a lower packer 123 proximate to the bottom 120*a* of the outer string 120.

The outer string 120 further includes an isolation packer for each zone, such as packer 124*a* for zone Z1, packer 124*b* for zone Z2 and packer 124*n* for zone Zn. The lower packer 123 isolates the sump packer 109 from hydraulic pressure exerted in the outer string 120 during fracturing and sand packing of the production zones Z1-Zn. In some cases, the sump packer 109 may be utilized as the lower packer 123. In one non-limiting embodiment, some or all isolation packers 124*a*-124*n* may be configured to be deployed at the same time or substantially at the same time. The packers 124*a*-124*n* may be configured to be deployed by any mechanism known in the art, including, but not limited to, hydraulically, power charge, mechanically and electrically. Similarly, packer 123 may be configured to be deployed with the isolation packers or independently, hydraulically, mechanically or by another mechanism. A release module may be provided for each packer to release or deactivate its associated packer after it has been set or activated. In system 100, release module 126*a* is associated with packer 124*a*, release module 126*b* with packer 124*b* and release module 126*n* with packer 124*n*. In one embodiment, the release module may be placed above its associated packer. In another embodiment, the release module may be integrated with its associated packer. In yet another embodiment, one or more release modules may include an expansion device or joint or mechanism to enable the release module to expand and contract in the wellbore. The packers may be released or deactivated via release modules mechanically or by any other means available in the art. In operation, packer 124*a* when deployed or activated will isolate zone Z1 from the remaining zones, packers 124*a* and 124*b* will isolate zone Z2 and packers 124*n*-1 and 124*n* will isolate zone Zn. In one aspect all packers may be configured to be hydraulically set or activated when the pressure in the wellbore exceeds a selected threshold. In another aspect, packers 123 and 124*n* may be configured to be set at a pressure different from the pressure for the remaining packers. In one embodiment, packers 123 and 124*n* may be set before setting the remaining packers.

Still referring to FIG. 1, the outer assembly 120 further includes a sand screen placed adjacent to each zone. For example, screen S1 placed adjacent to zone Z1, screen S2 adjacent zone Z2 and screen Sn adjacent to zone Zn. In one non-limiting embodiment, each screen S1-Sn may be made by serially connecting two or more screen sections with interconnecting connection members, wherein the interconnections provide axial fluid communication between the adjacent screen sections. The outer string 120 further includes a fluid flow device, such as a sliding sleeve valve (also referred to herein as the "slurry outlet" or "frac sleeve") to supply a fluid 152 from the inner string 160 to the formation 102 via perforations. FIG. 1 shows a frac sleeve 140*a* below packer 124*a* for zone Z1, frac sleeve 140*b* for zone Z2 below packer 124*b* and frac sleeve 140*n* below packer 124*n* for zone Zn. Another fluid flow device, such a sleeve valve (also referred to herein as monitoring valve) is provided for each zone to allow formation fluid 150 to flow from the formation 120 to inside 120*b* of the outer assembly 120. FIG. 1 shows a monitoring valve 144*a* for zone Z1, valve 144*b* for zone Z2 and valve 144*n* for zone Zn. In FIG. 1 all frac sleeves 140*a*-140*n* and monitoring valves 144*a*-144*n* are shown closed. Each frac sleeve and monitoring valve may be configured to be independently opened and closed mechanically or by another means available in the art.

Still referring to FIG. 1, the outer string 120 further includes a disconnect module corresponding to each zone. In FIG. 1, disconnect module 170*a* is shown placed below frac sleeve 140*a*, disconnect module 170*b* below frac sleeve 140*b* and disconnect module 170*n* below frac sleeve 140*n*. In another embodiment, the disconnect module may be placed at any other suitable location, such as between the packer and frac sleeve. In one embodiment, any disconnect module (170-170*n*) may include an expansion joint and disconnect device. A module containing an expansion joint and a disconnect device is disclosed in U.S. patent application Ser. No. 14/201,394, filed on Mar.7, 2014, (the '394 Application"), assigned to the assignee of the present application, which is incorporated in entirety herein by reference. In another embodiment, any disconnect module (170*a*-170*n*) may include only a disconnect device. Any other suitable disconnect module or device available in the art may be utilized for the purpose of this disclosure. In one aspect, a disconnect module causes the outer assembly to separate when a member therein has moved a selected distance. In one configuration, the disconnect module may be hydraulically armed and mechanically activated, such as described in the '394 Application. A feature of the disconnect module of the '394 Application disconnect module is that it includes a release device and a lock device inside a, wherein the lock device prevents shifting of the release device until the lock device is moved to an unlocked position by application of a first force to the lock device. The release device is movable to a released position by application of a second force after the lock device has been moved to the unlocked position. The lock device separates when the release device has moved a selected distance. Another feature of the '394 Application disconnect module is that it is hydraulically armed when a pressure above a threshold value is applied thereto but remains inactive or deactivated until mechanically activated. Such disconnect modules may be armed or initiated hydraulically at the same time or substantially at the same time and then each such module may be independently activated mechanically. Another feature of such a disconnect module is that when such a module is pulled upward mechanically, it expands or moves a certain distance and then separates into two portions or sections, thereby enabling the portion or section of the outer assembly above the separation point to be pulled upward or uphole and thus from the wellbore. In other aspects, the disconnect modules 170*a*-170*n* may be hydraulically armed and hydraulically activated using different pressures (forces), mechanically armed and mechanically activated, hydraulically armed and mechanically activated or mechanically armed and hydraulically activated. Thus, in one aspect, if any of the disconnect modules has been armed but not activated, it will not allow the outer assembly to separate at that disconnect module. If, however, a disconnect module is armed and activated, pulling the outer assembly will cause it to separate at such disconnect module. Therefore, if two or more disconnect modules have been armed and activated, pulling the outer assembly 120 will cause the outer string 120 to separate at the uppermost disconnect module that has been armed and activated. In another embodiment, a disconnect module may include a shear device, such as a shear pin or shear screw, which is sheared when the outer assembly 120 is pulled upward. This may require additional pull force compared to the force required to move the outer assembly further, which also may provide an indication to an operator about the separation of the outer assembly. In another embodiment, any disconnect module may include dogs that enable separation when upward pull force or load exceeds a certain threshold. Such devices are known in the art and are thus not described in detail herein. Additionally, the disconnect modules 170*a*-170*n* may be configured to include a seal device, including but not limited to, a seal or a seal surfaces remains in the wellbore once the disconnect module has separated. After a section of the outer assembly has been removed at such a disconnect, another or new outer assembly that includes a seal device (surface or seal interface) may then run into the wellbore to interface with seal device of the disconnect module left behind in the wellbore so that the zones corresponding to the new outer assembly may be treated in the manner described herein.

Still referring to FIG. 1, in one non-limiting embodiment, the inner assembly 160 includes an opening shifting tool 162 configured to open devices such as the monitoring valves 144*a*-144*n* and frac sleeves 140*a*-140*n*, and a closing shifting tool 164 to close such devices. The inner string 160 also includes an up-strain locating tool 168 for locating specific location on the outer string 120, such as locations 192*a*-192*n* respectively corresponding to zones Z1-Zn, and a set down tool 169 for setting the inner string 160 at any of the set down locations 190*a*-190*n* respectively corresponding to zones Z1-Zn for performing treatment operations. The inner string 160 further includes a plug 172 above the locating tool 169, which prevents fluid communication between the space 172*a* above the plug 172 and space 172*b* below the plug 172. The inner string 160 further includes a crossover tool 174 (also referred to herein as the "frac port") for providing a fluid path 175 between the inner string 160 and the outer string 120. In one aspect, the frac port 174 also includes flow passages 176 therethrough, which passages provide fluid communication between space 172*b* and 172*c*. In practice, the outer assembly 120 and the inner assembly 160 are run into the wellbore 101 with: all packers 123, 124*a*-124*n* deactivated; all release modules 126*a*-126*n* deactivated; all frac sleeves 140*a*-140*n* closed; all monitoring valves 144*a*-144*n* closed; and all disconnect modules 170*a*-170*n* unarmed and deactivated. The lower end 120*c* of the outer assembly 120 is stabbed into the sump packer 109 to provide a seal. At this stage, the opening device 162 is below the monitoring valve 144*a* of the lowermost section of 121*a* of the outer string 120. In this position, the wellbore is ready for a treatment operation.

To perform a treatment operation in a particular zone, for example zone Z1, lower packer 123 and upper packer 124*n* are set or deployed. Setting the upper packer 124*n* and lower packer 123 anchors the outer string 120 inside the casing 104. In one embodiment, the remaining packers 124*a*, 124*b*, etc. are then set to isolate each zone from the other zones. In one embodiment, packers 124*a*-124*n* may be set by applying a fluid pressure inside the outer assembly 120 that exceeds a threshold or by any other mechanism. In one embodiment, such packers may be set using a common pressure at the same or substantially the same time. In one embodiment, the same hydraulic pressure may be used to arm each of the disconnect modules 170*a*-170*n*. At this stage, all disconnect modules 170*a*-170*n* are armed but not activated. Therefore, if the outer string is pulled, each of the release modules 126*a*-126*n*, starting with the uppermost release module 126*n*, will sequentially release or deactivate its associated packer and enable the entire outer string 120 to be pulled up or removed from the wellbore 101.

Figure 2:
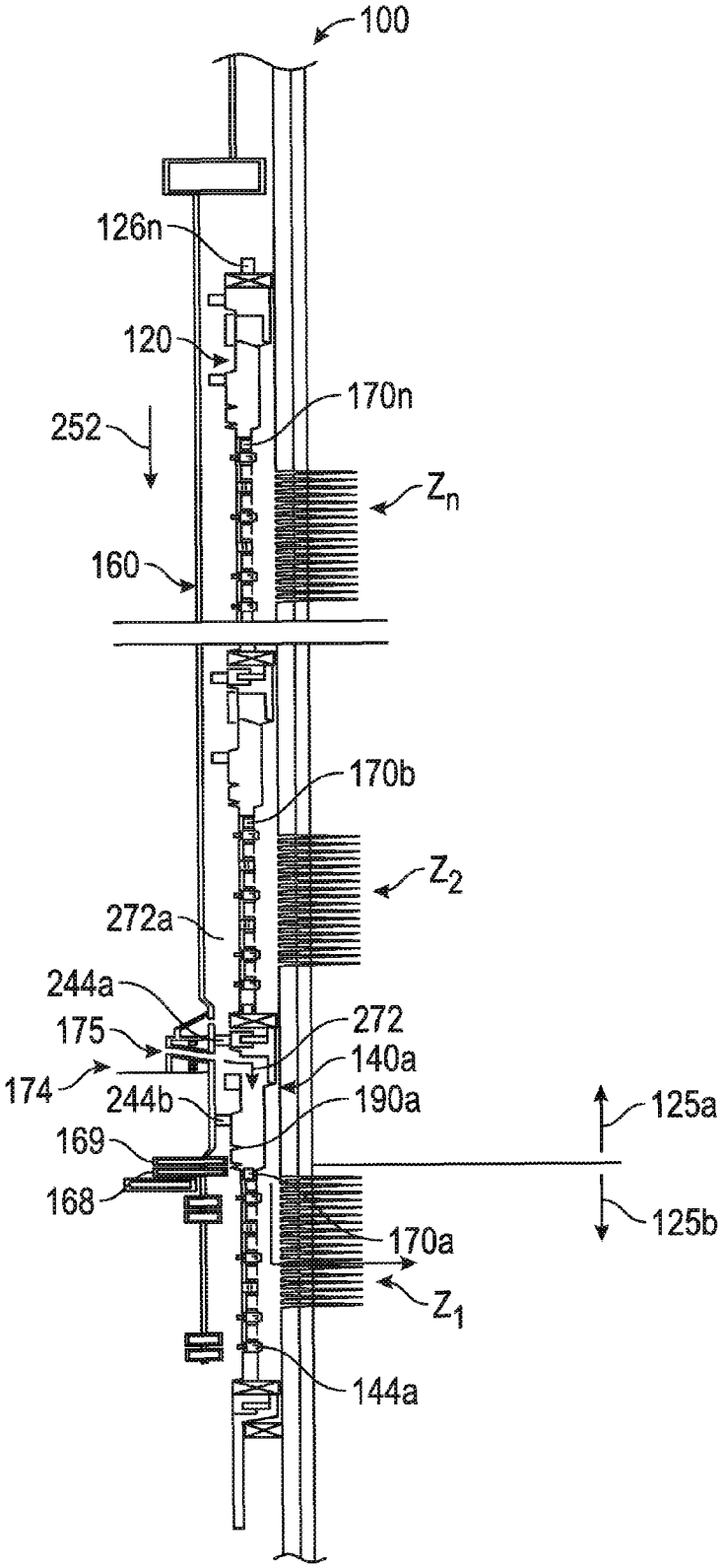
FIG. 2 shows the assembly of FIG. 1 configured to perform a treatment operation and retrieval of the completion assembly above the completed zone in a single trip.

Referring now to FIGS. 1 and 2, to perform a treatment operation in a particular zone, for example the lowermost zone Z1, the inner string 160 is manipulated (moved up and down as needed) to open the monitoring valve 144*a* and the frac sleeve 140*a*. The inner assembly 160 is further manipulated to locate the locating profile 192*a* and to then set the set down tool 169 at the set down profile 190*a* so that the frac port 174 is aligned with the frac sleeve 140, which is open, as shown in FIG. 2. Seals 244*a* and 244*b* are activated to seal a section 272 around the frac sleeve 140*a*. A treatment fluid 252, such as slurry (which may include water, proppant and additives) supplied from the surface under pressure will flow to the perforation via the frac port 174 and the frac sleeve 140*a* as shown by arrows 262. In some cases, the inner string 160 may become stuck inside the outer string 120 due to excessive accumulation of the proppant or other reasons. It then may be desirable to remove as much of the outer assembly 120 as possible in a single operation or trip.

In the system shown in FIG. 2, if the inner assembly 160 is stuck, the inner assembly may first be cut at a suitable location and removed. In one non-limiting embodiment, the inner string may include a weak link or point 161 to enable breaking of the inner assembly 160 at such weak link. Then pulling the outer assembly 120 upward will cause the uppermost release module 126*n* to release or deactivate the uppermost packer 120*n*, allowing the pull load on the outer string 120 to act on the next lower release module to release its associated packer and so on to release all packers in a sequential order, except any packer that is below the stuck point. Thus, in the example of FIG. 2, all packers 124*a*-124*n* will be released when the string 120 is pulled upward because none of the disconnect modules, except module 170*a*, has been activated.

Packer 123 will not be released as it is below the disconnect module 170*a*. Pulling upward the outer string 120 further will cause the disconnect module 170*a* to separate and allow pulling of the upper portion 125*a* of the outer assembly 120 from the wellbore 101, while leaving the lower portion 125*b* of the outer string 120 to remain in the wellbore 101. If the treatment had also been performed in zone Z2, then both disconnect modules 170*a* and 170*b* would have been activated. In such a case, the portion of the outer string 120 above the uppermost disconnect module (in this example 170*b*) that has been activated will be removed in a single operation or single trip.

Thus, in various aspects, as discussed above in reference to FIGS. 1 and 2, running in and retrieval of a completion assembly 110 in a wellbore is disclosed. In one aspect, the outer assembly 120 may include a disconnect module corresponding to each section of a multi-zone system to facilitate retrieval of the outer assembly 120 from the wellbore 101 when the inner assembly 160 becomes stuck for any other reason. In one non-limiting embodiment, one or more of the disconnect modules (170*a*-170*n*) may contain a disconnect device or a combination of a disconnect device and an expansion joint. The disconnect modules (170*a*-170*n*) may be hydraulically armed or locked at the same time and mechanically released individually or independently by the inner assembly 160. A disconnect module will not disconnect unless activated. Pulling of the outer assembly 120 will cause the outer assembly to separate at the top most disconnect modules that has been armed and activated. An isolation packer may be released from its set positions by an associated release module when the outer string is pulled upward. In another aspect, the packer release module may also function as an expansion joint and when it reaches the end of its stroke, it will release its associated packer. Before treating a selected zone, the disconnect module below the isolation packer for that zone is activated. This allows that particular disconnect module to function as an expansion joint. If a retrieval of the outer assembly 120 is performed by pulling it upward, the uppermost isolation packer 124*n* will be released first. Continued pulling of the outer assembly 120 will pull through the deactivated disconnect module below the uppermost packer 124*n*. This pull load will continue to the top of the packer release module above the uppermost disconnect module that has been activated. Continued pulling of the outer assembly 120 will separate the outer assembly 120 from uppermost disconnect module that has been activated. In general, during a frac-pack operation, the inner assembly 160 is most likely to be stuck directly below the isolation packer. Therefore, placing the disconnect module below the packer and the lock mechanism in the expansion joint of the disconnect module (i.e., armed but not activated aspect) enables removal of the outer string 120 from below such isolation packers. The hydraulically arming and mechanically activating of the disconnect modules enable running of the inner assembly 160 through the outer assembly 120 on the rig floor without prematurely activating any of the disconnect modules (170*a*-170*n*). Also, the expansion joints in the disconnect module, such as described in the '394 Application, the expansion joints operate to absorb contraction of the outer assembly 120 due to cooling of the outer assembly during treatment operations because the treatment fluid is typically cooler than the fluid in the formation. In other aspects, isolation packers 124*a*-124*n* may be set sequentially. In addition, the release modules 126*a*-126*n* may include a feature that allows for selectively disconnecting above a packer instead of releasing it, such as by rotating the outer assembly prior to actually releasing a particular packer with the release module. This step allows the packer to remain in place and thus retrieval of the inner assembly when it is not stuck. This also allows the retrieval of the outer assembly above the selected packer. The disconnect module may also allow other operations, such as cutting operations.

The foregoing disclosure is directed to certain exemplary embodiments and methods of the present disclosure. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A completion assembly for use in a wellbore, comprising:

an outer assembly for placement in the wellbore, the outer assembly including:

an isolation packer corresponding to each of a plurality of zones along the wellbore, wherein each isolation packer is configured to be set in the wellbore;

a release module associated with each isolation packer to deactivate its associated isolation packer from a set position after such isolation packer has been set in the wellbore; and a disconnect module below each isolation packer for separating the outer assembly into two sections wherein the disconnect module is armed using a first force and activated using a second mechanical force.

2. The completion assembly of claim 1, wherein at least one of the disconnect modules is configured to be activated independently.

3. The completion assembly of claim 1, wherein the outer assembly, when pulled upward, will disconnect at an uppermost disconnect module in the outer assembly that has been activated.

4. The completion assembly of claim 1, wherein at least one disconnect module includes an expansion joint that separates after the expansion joint has traveled a selected distance, thereby enabling the outer string to separate at such disconnect module.

5. The completion assembly of claim 4, wherein the at least one disconnect module includes a shearing device that shears when the expansion joint travels the selected distance.

6. The completion assembly of claim 4, wherein the at least one disconnect module includes a first seal device that remains in the wellbore after outer assembly has been separated at such disconnect module, wherein the first seal device allows creating of a seal between the first seal device and a second seal device run into the wellbore.

7. The completion assembly of claim 1, wherein at least one release module further includes an expansion joint.

8. The completion assembly of claim 1, wherein at least one release module is integrated into its associated packer.

9. The completion assembly of claim 1 further comprising:

an inner assembly movable in the outer assembly that includes an activation tool to independently and activate each disconnect module.

10. The completion assembly of claim 9, wherein the inner assembly is configured to be set in the outer assembly to align a crossover port in the inner assembly with a flow port corresponding to each zone in the outer assembly to supply a treatment fluid to each such flow port.

11. The completion assembly of claim 1, wherein each disconnect module is configured to be armed when the wellbore is subjected to a pressure above a threshold pressure.

12. The completion assembly of claim 1, wherein when the outer assembly is pulled upward: the release modules sequentially release their associated isolation packers; and the outer string is separated at the uppermost disconnect module that has been activated.

13. A method of placing a retrievable completion assembly in a multi-zone wellbore, the method comprising:

placing a completion assembly that includes an outer assembly and an inner assembly in the multi-zone wellbore, wherein the outer assembly includes: an isolation packer corresponding to each zone; a release module associated with each isolation packer to deactivate its associated isolation packer from a set position in the wellbore; and a disconnect module below each isolation packer for separating the outer assembly into two sections wherein the disconnect module is armed using a first hydraulic force and activated using a second mechanical force, wherein the outer assembly when pulled upward will disconnect at an uppermost disconnect module that has been armed and activated;

setting at least one isolation packer corresponding to at least one selected zone;

arming the disconnect module below the at least one set packer; and activating the disconnect module below the at least one set packer to allow for separation of the outer assembly at the activated disconnect module.

14. The method of claim 13, wherein the outer assembly includes a flow port corresponding to each zone and the inner assembly includes a frac port for supplying a treatment fluid to each of the flow ports, wherein the method further comprises:

isolating an area around the flow port corresponding to the selected zone;

opening the flow port corresponding to the selected zone; and supplying the treatment fluid to the selected zone via the frac port and the flow port corresponding to the selected zone.

15. The method of claim 14 further comprising:

pulling the outer assembly to cause the outer assembly to separate at the activated disconnect module; and removing the outer assembly from the wellbore.

16. The method of claim 13, wherein at least one disconnect module includes an expansion joint that expands after the disconnect module has been armed and separates after a selected travel after it has been activated.

17. The method of claim 13, the methodfurther comprises:

hydraulically setting all isolation packers;

hydraulically arming all disconnect modules; and treating the at least one selected zone.

18. The method of claim 13, wherein the inner assembly is movable in the outer assembly and includes an activation tool configured to activate each disconnect module.

19. The method of claim 13, wherein when the outer assembly is pulled upward, the release modules sequentially release their associated isolation packers and enable an upper section of the outer assembly to disconnect from a remaining section of the outer assembly at an uppermost disconnect module that has been activated to allow the outer assembly to be pulled from the wellbore.

* * * * *